United States Patent [19]

Iwata

[11] Patent Number: 4,519,370

[45] Date of Patent: May 28, 1985

[54] FUEL INJECTOR ELECTRONICALLY CONTROLLED ENGINE

[75] Inventor: Minoru Iwata, Susono, Japan

[73] Assignee: Toyota Jidosha Kabushiki Kaisha, Toyota, Japan

[21] Appl. No.: 491,642

[22] Filed: May 4, 1983

[30] Foreign Application Priority Data

Feb. 23, 1983 [JP] Japan ..... 58-24452[U]

[51] Int. Cl.[3] ..... F02B 15/00

[52] U.S. Cl. ..... 123/432; 123/472; 123/478; 123/585; 239/533.12

[58] Field of Search ..... 123/432, 308, 472, 478; 239/533.12

[56] References Cited

U.S. PATENT DOCUMENTS

| | | | |
|---|---|---|---|
| 1,977,005 | 10/1934 | Mock | 239/533.12 |
| 3,782,639 | 1/1974 | Boltz | 123/472 |
| 4,300,504 | 11/1981 | Tezuka | 123/432 |
| 4,361,126 | 11/1982 | Knapp et al. | 123/472 |
| 4,434,766 | 3/1984 | Matsuoka | 123/472 |

FOREIGN PATENT DOCUMENTS

| | | | |
|---|---|---|---|
| 0160156 | 12/1980 | Japan | 123/445 |
| 400836 | 11/1933 | United Kingdom | 239/533.12 |

*Primary Examiner*—E. Rollins Cross

*Attorney, Agent, or Firm*—Cushman, Darby & Cushman

[57] ABSTRACT

A combustion chamber in each cylinder has a plurality of intake valves and intake air is distributed into respective divided flow intake air path portions to enter each combustion chamber from a plurality of the intake valves through these divided flow intake air path portions. And in a fuel injector, injected fuel collides with injected air to promote atomization of injected fuel. Each fuel injector has a plurality of fuel injection ports directed to the respective divided flow intake air path portions and a plurality of air-fuel injection ports which are provided coaxially with the respective fuel injection ports and through which injected fuel passes after colliding with injected air. As a result the injected fuel is smoothly distributed to the respective divided flow intake air path portions.

5 Claims, 8 Drawing Figures

FUEL INJECTOR ELECTRONICALLY CONTROLLED ENGINE

BACKGROUND OF THE INVENTION

1. Field of the Invention

This invention relates to a fuel injector for an electronically controlled engine in which each combustion chamber has a plurality of intake valves and particularly to an fuel injector for making injected fuel collide with injected air to atomize the fuel.

2. Description of the Prior Art

In such electronically controlled engine, intake air is divided into respective divided flow intake air path portions divided by partition members to enter a combustion chamber through a plurality of intake valves. Conventional fuel injectors have only one fuel injection port so that fuel is injected usually toward the center of a plurality of divided flow intake air path portions, i.e. toward the partition member and then distributed to the respective divided flow intake air path portions. In this case, since the injected fuel abuts against the partition member to be attached to the wall surface thereof, atomizing of supplied fuel is degraded while supply of fuel to the combustion chamber is delayed. Accordingly, responsive property of the engine in acceleration is degraded while troubles such as defective combustion and increase of discharge amount of noxious components due to deviation of air-fuel ratio of mixture in the combustion chamber take place.

SUMMARY OF THE INVENTION

An object of the present invention is to provide a fuel injector for a multiple intake valve type electronically controlled engine which can prevent injected fuel from attachment and deposit to a partition member to remove troubles of prior art.

According to the present invention to achieve this object, in an electronically controlled engine wherein a combustion chamber in each cylinder has a plurality of intake valves to divide intake air into each divided flow intake air path portion so that the divided flow intake air enters the combustion chamber through a plurality of intake valves and a fuel injector is provided upstream of the divided flow intake air path portion to atomize injected fuel colliding with injected air, the fuel injector has a plurality of fuel injection ports directed to the respective divided flow intake air path portions and fuel injection ports and a plurality of air-fuel injection ports which are provided coaxially with the respective fuel injection ports and through which injected fuel passes after colliding with injected air.

Since a plurality of fuel injection ports and air-fuel injection ports are thus provided in the fuel injector, fuel is injected to the respective divided flow intake air path portions without colliding with the partition member and introduced smoothly into the combustion chamber through each intake valve. Thus, atomization of injected fuel and introduction of same into the combustion chamber are improved to improve responsive property in acceleration and efficiency of fuel consumption, and emission of noxious components can be restrained.

The fuel injection port may be provided in a fuel injector body and air-fuel injection port may be provided in an adapter mounted on the end of the fuel injector body. To set a plurality of fuel injection ports and air-fuel injection ports to the respective divided flow intake air path portions in the circumferential positions, circumferentially locating means are provided on the adapter, fuel injector body and engine mounting portions.

Further, preferably the interior of the adapter is divided into sections corresponding to the respective fuel injection ports to equalize distribution of fuel from the respective air-fuel injection ports. The surface of the partition wall in the adapter is preferably formed like a cone diverging toward the air fuel injection port. Thus, attachment of injected fuel to the inside wall of the partition is restrained.

The above-mentioned and other objects and features of the invention will become apparent from the following detailed description taken in conjunction with the drawings which indicate embodiments of the invention.

DETAILED DESCRIPTION OF THE PREFERRED EMBODIMENTS

Figure 1:
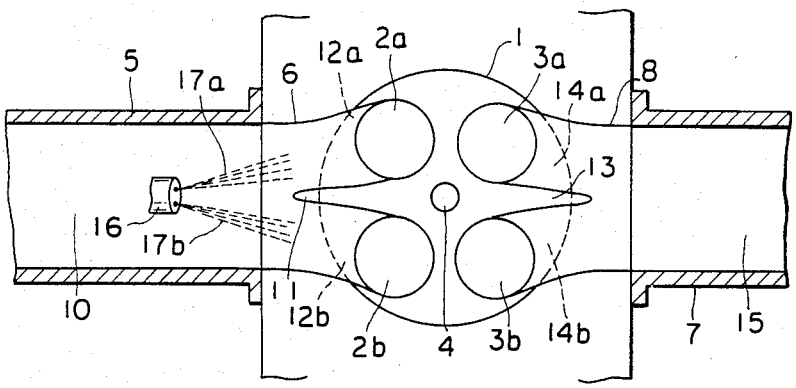
FIG. 1 shows neighborhood of a combustion chamber in a multiple intake valve type of an electronically controlled fuel injection engine.

In FIG. 1, a combustion chamber 1 has two intake valves 2*a*, 2*b* and two exhaust valves 3*a*, 3*b* and is provided on the top with an ignition plug 4. As intake pipe 5 is connected to an intake port 6 to guide intake air from a surge tank to the intake port 6. An exhaust pipe 7 is connected to an exhaust port 8 to guide exhaust gas. An intake path 10 is divided into divided flow intake air path portions 12*a*, 12*b* at the intake port 6 by a partition member 11 and communicates to intake valves 2*a*, 2*b*. Similarly, a partition member 13 in an exhaust port 8 divides an exhaust path portion 15 into two divided flow exhaust path portions 14*a*,14*b* of the respective exhaust valves 3*a*, 3*b* to be combined with the exhaust path portion 15. A fuel injector 16 is mounted on the intake pipe 5 upstream of the partition member 11 to inject two fuel bundles 17*a*, 17*b* respectively toward the divided flow intake air path portions 12*a*,12*b*.

Figure 2:
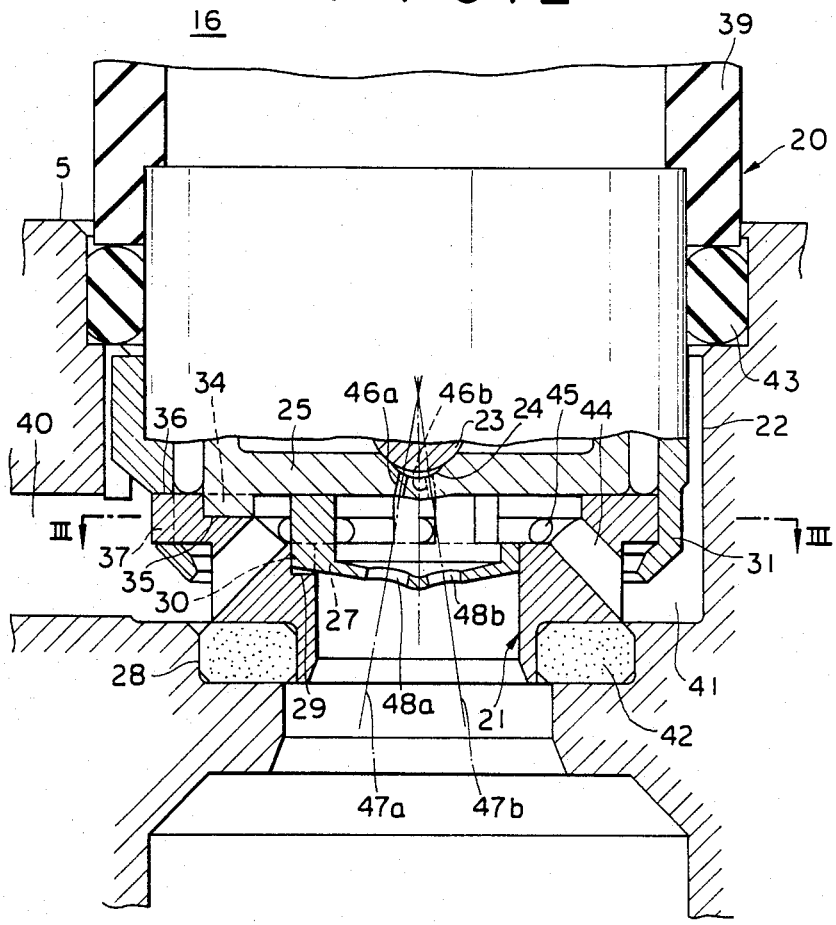
FIG. 2 is a sectional view taken along the line II—II of FIG. 3, showing an embodiment of the present invention.
Figure 3:
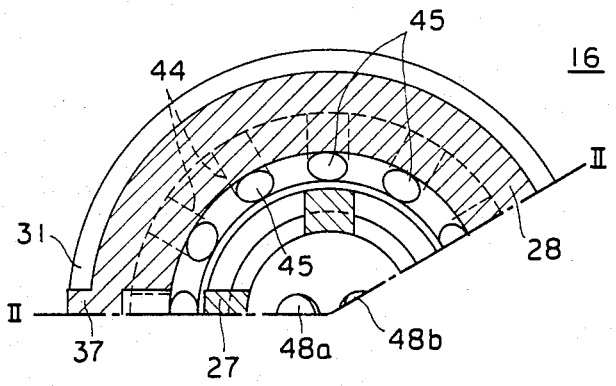
FIG. 3 is a sectional view taken along the line III—III of FIG. 2.
Figure 4:
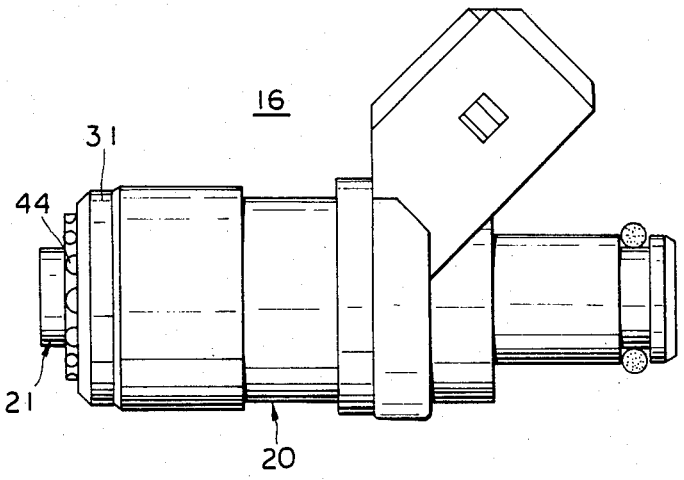
FIG. 4 is an outline drawing of a fuel injector shown in FIG. 2.

In FIG. 2–4, the fuel injector 16 consists of a fuel injector body 20 and an adapter 21 mounted on the end thereof and is inserted into a hole 22 of the intake pipe. A valve body 23 has the spherical lower end closely attached to a valve seat 24 of a valve body 25 to be operated by a solenoid. The adapter 21 has an inside member 27 and an outside member 28, both members 27, 28 being in fitting connection with each other. A recess 29 and a projection 30 fitting each other are provided at one circumferential portion as a locating means for determining the circumferential position of both members 27, 28. The adapter 21 is mounted on the lower end of the body 20 by caulking a housing 31 of the body 20. A projection 34 on the valve body 25 of the body 20 and a recess 35 in the adapter 21 and a hole 36 in the housing 31 and a projection 37 on the adapter 21 fit each other respectively to locate circumferentially the body 20 and adapter 21. An air introducing path 40 is connected to an intake path upstream of a throttle valve so that air is sucked and introduced through the air introducing path 40 to an annular space 41 in the outer periphery of the adapter 21 by negative pressure in the intake pipe. A seal 42 and O-ring 43 maintain airtight of the annular space 41. The O-ring 43 is fixed by an annular rubber body 39 fitting the outer periphery of the body 20. The member 28 of the adapter 21 is formed in the peripheral wall with a path 44 extending radially inward and obliquely upward, and an air introducing port 45 at the inside end of the path 44 is opened to the outer peripheral space of the member 27. The valve body 25 is formed with two fuel injection ports 46*a*, 46*b* having the axes 47*a*, 47*b* aligned with the center lines of the divided flow intake air path portions 12*a*, 12*b* shown in FIG. 1, and air-fuel injection ports 48*a*, 48*b* in the member 27 have the centers located above the center axes 47*a*, 47*b* of the fuel injection ports 46*a*, 46*b*. The areas of the air-fuel injection ports 48*a*, 48*b* are selected to set air flow guided through the air introducing path 40 to a proper value, and the distance between the fuel injection ports 46*a*, 46*b* and the air-fuel injection ports 48*a*, 48*b* permits fuel to be injected from the fuel injection ports 46*a*, 46*b* without abutting against the peripheral edge of the air-fuel injection ports 47*a*, 47*b* when air is not introduced from the air introducing port 45. When a throttle valve is approximately fully opened, the negative pressure in the intake pipe and flow of the injected fuel are reduced. However in this case, i.e. when introduced air disappears, the distance between the fuel injection ports 46*a*, 46*b* and the air-fuel injection ports 48*a*, 48*b* is determined to restrain attachment of fuel to the adapter 21.

Air injected from the air introducing port 45 collides with fuel injected from the fuel injection ports 46*a*, 46*b* to atomize further the injected fuel. The injected fuel, after passing through the air-fuel injection ports 48*a*, 48*b*, advances along the axes 47*a*, 47*b* and enters the combustion chamber 1 from the intake valves 2*a*, 2*b* without colliding with and attaching to the partition member 11. Thus, since the injected fuel is smoothly supplied to the combustion chamber 1, desirably atomized fuel is introduced into the combustion chamber 1 to improve responsive property in acceleration and stabilize combustion for reducing an amount of noxious components in exhaust.

Figure 5:
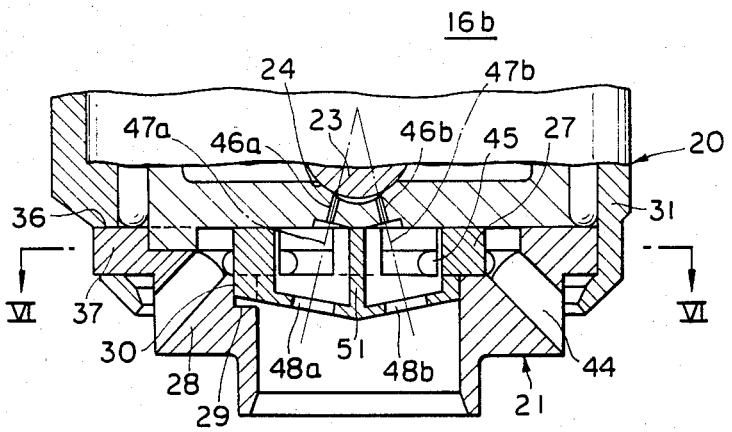
FIG. 5 is a sectional view of another embodiment of the present invention.
Figure 6:
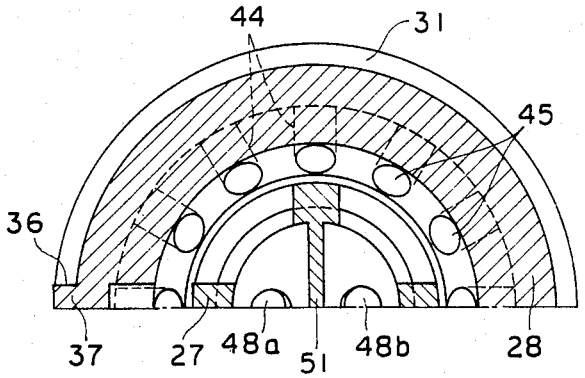
FIG. 6 is a sectional view taken along the line VI—VI of FIG. 5.

FIGS. 5, 6 show another embodiment of the present invention. In this fuel injector 16*b*, the inside member 27 of the adapter 21 is provided with a partition wall 51 which serves to divide fuel injected from the respective fuel injection ports 46*a*, 46*b*. Thus, the fuel injected from the respective fuel injection ports 46*a*, 46*b* is discharged from the air-fuel injection ports 48*a*, 48*b* without mixing with each other in the adapter 21 to be sent to the intake valves 2*a*, 2*b*. Accordingly the fuel is uniformly distributed to the respective divided flow intake air path portions 12*a*, 12*b* without deviation.

Figure 7:
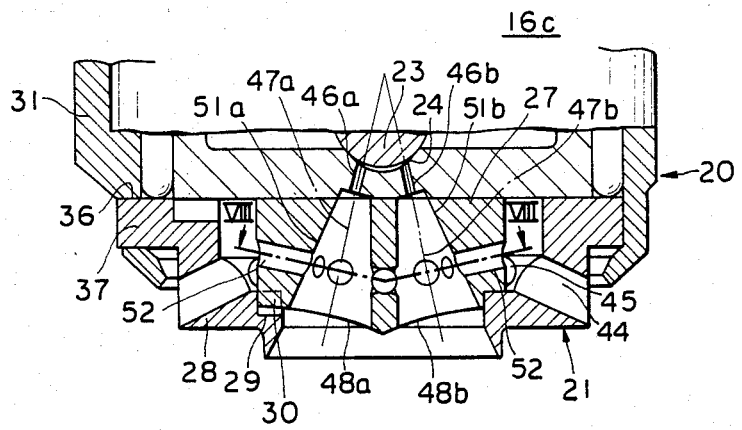
FIG. 7 is a sectional view of still another embodiment of the present invention.
Figure 8:
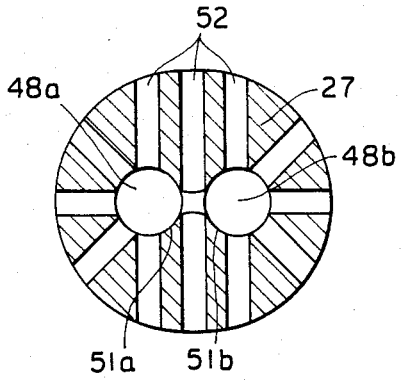
FIG. 8 is a sectional view taken along the line VIII—VIII of FIG. 7.

FIGS. 7, 8 show still another embodiment of the present invention. In this fuel injector 16*c*, an inner surface 51 of the partition wall dividing fuel injected from the fuel injection ports 46*a*, 46*b* in the inside member 27 is formed like a conical surface diverging toward the air-fuel injection ports 48*a*, 48*b*. The fuel injected from the fuel injection ports 46*a*, 46*b* diverges as it advances, while the increase of the inside diameters of inside surfaces 51*a*, 51*b* are set to the expansion of the injected fuel. The member 27 is formed with paths 52 extending obliquely downward from the outer periphery to the inside surfaces 51*a*, 51*b*, and openings of the paths 52 in said surfaces 51*a*, 51*b* are provided at equal intervals circumferentially as air injection ports. Thus, injected air can be uniformly distributed circuferentially of fuel injected from the fuel injection ports 46*a*, 46*b*. The inside surfaces 51*a*, 51*b* of the conical surface prevent the attachment and deposit of injected fuel in the adapter 21 so that fuel is smoothly supplied to the combustion chamber 1.

While the invention has been described and illustrated with reference to a specific embodiment thereof, it will be understood that other embodiments may be resorted to without departing from the invention. Therefore, the form of the invention set out above should be considered as illustrative and not as limiting the scope of the following claims.

What is claimed is:

1. In an internal combustion engine wherein a combustion chamber has a plurality of intake valves, intake air is divided into intake air path portions each leading to one of the intake valves and a fuel injector is provided upstream of the intake air path portions, said injector having means for admitting air thereto to collide with injected fuel in the fuel injector to atomize the injected fuel, characterized in that:

the fuel injector has a plurality of fuel injection ports directed into the respective intake air path portions and a plurality of air-fuel injection ports each aligned coaxially downstream of a respective fuel injection port and through which injected fuel passes after colliding with incoming air.

2. A fuel injector as defined in claim 1, including an adapter mounted on the end of the body of the fuel injector and provided with the air-fuel injection ports and interengaging means on said fuel injector and said adapter for assuring alignment of said air-fuel ports with the fuel injection ports.

3. A fuel injector as defined in claim 1 wherein locating means for regulating the circumferential position of the fuel injector to a mounting portion of the fuel injector in an engine are provided on the mounting portion and the fuel injector.

4. A fuel injector as defined in claim 2 wherein the interior of the adapter is divided into portions corresponding to the respective fuel injection ports.

5. A fuel injector as defined in claim 4 wherein each interior adapter portion is formed like a cone diverging toward the air-fuel injection port.

* * * * *